US009734979B2

(12) United States Patent
Tang et al.

(10) Patent No.: US 9,734,979 B2
(45) **Date of Patent: *Aug. 15, 2017**

(54) X-RAY APPARATUS AND A CT DEVICE HAVING THE SAME

(71) Applicants: NUCTECH COMPANY LIMITED, Beijing (CN); TSINGHUA UNIVERSITY, Beijing (CN)

(72) Inventors: Huaping Tang, Beijing (CN); Chuanxiang Tang, Beijing (CN); Huaibi Chen, Beijing (CN); Wenhui Huang, Beijing (CN); Shuxin Zheng, Beijing (CN); Huayi Zhang, Beijing (CN); Yaohong Liu, Beijing (CN)

(73) Assignees: Nuctech Company Limited, Beijing (CN); Tsinghua University, Beijing (CN)

( * ) Notice: Subject to any disclaimer, the term of this patent is extended or adjusted under 35 U.S.C. 154(b) by 100 days.

This patent is subject to a terminal disclaimer.

(21) Appl. No.: 14/490,535

(22) Filed: Sep. 18, 2014

(65) Prior Publication Data

US 2015/0078510 A1 Mar. 19, 2015

(30) Foreign Application Priority Data

Sep. 18, 2013 (CN) ..... 2013 1 0427001

(51) Int. Cl.
*H01J 35/06* (2006.01)
*H01J 35/12* (2006.01)
(Continued)

(52) U.S. Cl.
CPC ..... *H01J 35/06* (2013.01); *H01J 35/12* (2013.01); *H01J 35/24* (2013.01); *H05G 1/10* (2013.01);
(Continued)

(58) Field of Classification Search
CPC ..... A61B 6/032; A61B 6/035; A61B 6/4007; A61B 6/4014; A61B 6/4021;
(Continued)

(56) References Cited

U.S. PATENT DOCUMENTS 4,274,005 A 6/1981 Yamamura et al.
4,926,452 A 5/1990 Baker et al.
(Continued)

FOREIGN PATENT DOCUMENTS

CN 101101849 A 1/2008
CN 102811544 A 12/2012
(Continued)

*Primary Examiner* — Jurie Yun
(74) *Attorney, Agent, or Firm* — McDermott Will & Emery LLP

(57) ABSTRACT

The present application provides a curved surface array distributed x-ray apparatus, characterized in that, it comprises: a vacuum box which is sealed at its periphery, and the interior thereof is high vacuum; a plurality of electron transmitting units arranged on the wall of the vacuum box in multiple rows along the direction of the axis of the curved surface in the curved surface facing the axis; an anode made of metal and arranged in the axis in the vacuum box which comprises an anode pipe and an anode target surface; a power supply and control system having a high voltage power supply connected to the anode, a filament power supply connected to each of the plurality of the electron transmitting units, a grid-controlled apparatus connected to each of the plurality of electron transmitting units, a control system for controlling each power supply.

12 Claims, 6 Drawing Sheets

(51) Int. Cl.

| | |
|---|---|
| ***H05G 1/10*** | (2006.01) |
| ***H01J 35/24*** | (2006.01) |
| *H01J 35/16* | (2006.01) |
| *H05G 1/70* | (2006.01) |

(52) U.S. Cl.
CPC ..... *H01J 35/16* (2013.01); *H01J 2235/068* (2013.01); *H01J 2235/087* (2013.01); *H05G 1/70* (2013.01)

(58) Field of Classification Search
CPC ..... A61B 6/4028; H01J 35/02; H01J 35/04; H01J 35/045; H01J 35/06; H01J 35/065; H01J 35/08; H01J 35/14; H01J 35/16; H01J 35/12; H01J 2235/06; H01J 2235/062; H01J 2235/068; H01J 2235/08; H01J 2235/083; H01J 2235/086; H05G 1/52; H05G 1/04; H05G 1/06; H05G 1/08; H05G 1/085; H05G 1/00; H05G 1/02; H05G 1/025; H05G 1/10
USPC ..... 378/4, 9, 10, 121, 122, 123, 124, 134, 378/136, 137, 138, 141
See application file for complete search history.

(56) References Cited

U.S. PATENT DOCUMENTS

| | | | | |
|---|---|---|---|---|
| 2003/0072407 | A1* | 4/2003 | Mihara ..... | A61B 6/032 378/4 |
| 2010/0189223 | A1 | 7/2010 | Eaton et al. | |
| 2011/0286581 | A1* | 11/2011 | Sprenger ..... | H01J 35/04 378/113 |
| 2015/0078532 | A1* | 3/2015 | Tang ..... | H01J 35/14 378/134 |

FOREIGN PATENT DOCUMENTS

| | | | |
|---|---|---|---|
| CN | 203178216 | U | 9/2013 |
| CN | 203563254 | U | 4/2014 |
| CN | 203590580 | U | 5/2014 |
| CN | 103908288 | A | 7/2014 |
| CN | 203734907 | U | 7/2014 |
| WO | WO-2005/117058 | A1 | 12/2005 |
| WO | WO-2010/131209 | A1 | 11/2010 |
| WO | WO-2011/119629 | A1 | 9/2011 |

* cited by examiner (1)

(2)

(3)

X-RAY APPARATUS AND A CT DEVICE HAVING THE SAME

TECHNICAL FIELD

The present application relates to an apparatus generating distributed x-ray, in particular to a curved surface array distributed x-ray apparatus generating x-ray altering the position of focus in a predetermined order in a x-ray light source device by arranging a plurality of independent electron transmitting units in a curved surface and arranging anode in the axis and by cathode control or grid control and a CT device having the curved surface array distributed x-ray apparatus.

BACKGROUND

In general, x-ray presents a wide range of applications in the fields of nondestructive detection, security check and medical diagnoses and treatment etc. In particular, the x-ray fluoroscopic imaging device utilizing the high penetrability of the x-ray plays a vital role in every aspect of people's daily lives. The early device of this type is a film flat fluoroscopic imaging device. Currently, the advanced technology is digital, multiple visual angles and high resolution stereoscopic imaging device, e.g. CT (computed tomography), being able to obtain three-dimensional graphs or slice image of high definition, which is an advanced application.

In the current CT device, the x-ray source and the detector need to move on the slip ring. In order to increase the speed of inspection, the moving speeds of x-ray source and the detector are normally high leading to a decreased overall reliability and stabilization. In addition, due to the limit of moving speed, the inspection speed of the CT is limited accordingly. Therefore, there is a need for the x-ray source generating multiple visual angles without displacing.

To address the problems of reliability, stabilization and inspection speed caused by the slip ring as well as the heat resistance problem of the anode target spot, there are methods provided in the available patent literature. For example, rotating target x-ray source can solve the overheat of the anode target to some extent. However, its structure is complex and the target spot generating x-ray is still a definite target spot position with respect to the overall x-ray source. For instance, in some technology, a plurality of dependent conventional x-ray sources are arranged closely in a periphery to replace the movement of x-ray source in order to realize multiple visual angles of a fixed x-ray source. Although multiple visual angles can be realized, the cost is high. In addition, the space between the target spots of different visual angles is big and the imaging quality (stereoscopic resolution) is quite poor. What's more, a light source generating distributed x-ray and the method thereof is disclosed in the patent literature 1 (U.S. Pat. No. 4,926,452), wherein the anode target has a large area remitting the overheat of the target and multiple visual angles could be produced since the position of target spot changes along the periphery. Although the patent literature 1 performs scanning deflection to the accelerated high-energy electron beam, there are still problems of difficult control, non-disjunction of target spots and poor repeatability. Anyway, it is still an effective way to generate distributed light sources. Moreover, the light sources generating distributed x-ray and methods thereof are proposed in the patent literature 2 (US20110075802) and patent literature 3 (WO2011/119629), wherein the anode target has a large area remitting the overheat of the target and multiple visual angles could be produced since the position of target spots are fixed dispersedly and are arranged in an array. In addition, CNTs (carbon nano tubes) are employed as cold cathodes and the cold cathodes are arranged in an array. The transmitting is controlled by utilizing the voltage between cathode and grid so as to control each cathode to emit electron in sequence and bombard the target spot on the anode in an order correspondingly, thus becoming the distributed x-ray source. However, there are disadvantages of complex manufacturing process and poor transmitting capability and short lifetime of carbon nano tubes.

SUMMARY

The present application is proposed to address the above-mentioned problems, the aim of which is to provide a curved surface array distributed x-ray apparatus and a CT device having the same in which multiple visual angles can be generated without moving the light source. This contributes to simplify the structure, enhance the stability and reliability of the system, hence increasing the efficiency of inspection.

To achieve the above-mentioned aim, the present application provides a curved surface array distributed x-ray apparatus, characterized in that, it comprises: a vacuum box which is sealed at its periphery, and the interior thereof is high vacuum; a plurality of electron transmitting units arranged on the wall of the vacuum box in multiple rows along the direction of the axis of the curved surface in the curved surface facing the axis; an anode made of metal and arranged in the axis in the vacuum box; a power supply and control system having a high voltage power supply connected to the anode, a filament power supply connected to each of the plurality of the electron transmitting units, a grid-controlled apparatus connected to each of the plurality of electron transmitting units, a control system for controlling each power supply; wherein the anode comprises: an anode pipe made of metal and having a hollow pipe shape; an anode support arranged on the anode pipe; an anode target surface provided on the outer surface of the anode pipe and facing the electron transmitting unit.

In addition, in the curved surface array distributed x-ray apparatus of this disclosure, the anode target is a sloping plane formed by cutting a portion of the excircle of the anode pipe.

In addition, in the curved surface array distributed x-ray apparatus of this disclosure, the anode target is formed by forming heavy metal material tungsten or tungsten alloy on the sloping plane formed by cutting a portion of the excircle of the anode pipe.

In addition, in the curved surface array distributed x-ray apparatus of this disclosure, the electron transmitting unit has a filament; a cathode connected to the filament; an insulated support having opening and enclosing the filament and the cathode; a filament lead extending from both ends of the filament; a grid arranged above the cathode opposing the cathode; a connecting fastener connected to the insulated support; wherein, the electron transmitting unit is installed on the walls of the vacuum box forming a vacuum seal connection, the grid having: a grid frame which is made of metal and provided with opening in the center; a grid mesh which is made of metal and fixed at the position of the opening of the grid frame; a grid lead, extending from the grid frame; wherein, the filament lead connected to the filament power supply and the grid lead connected to the grid control means extend to the outside of the electron transmitting unit through the insulated support.

In the curved surface array distributed x-ray apparatus of this disclosure, the connecting fastener is connected to the outer edge of the lower end of the insulated support, and the cathode end of the electron transmitting unit is located inside the vacuum box while the lead end of the electron transmitting unit is located outside the vacuum box.

In the curved surface array distributed x-ray apparatus of this disclosure, the connecting fastener is connected to the upper end of the insulated support, and the electron transmitting unit is overall located outside the vacuum box.

In addition, in the curved surface array distributed x-ray apparatus of this disclosure, it further comprises: a cooling means; a cooling connection means connected to the cooling means outside the vacuum box and connected to both ends of the anode and installed on the side surface of the vacuum box adjacent to the anode; a cooling control means included in the power supply and control system for controlling the cooling means.

In addition, in the curved surface array distributed x-ray apparatus of this disclosure, it further comprises: a high voltage power supply connecting means connecting the anode to the cable of the high voltage power supply and installed to the side wall of the vacuum box at the end adjacent to the anode, a filament power supply connecting means for connecting the filament to the filament power supply, a connecting means of grid-controlled apparatus for connecting the grid of the electron transmitting unit to the grid-controlled apparatus, a vacuum power supply included in the power supply and control system; a vacuum means installed on the side wall of the vacuum box maintaining high vacuum in the vacuum box utilizing the vacuum power supply.

In addition, in the curved surface array distributed x-ray apparatus of this disclosure, the curved surface array of the electron transmitting unit is configured such that in one direction it is arranged in arc and in the other direction it is arranged in a straight line or segmented lines.

In addition, in the curved surface array distributed x-ray apparatus of this disclosure, the curved surface array of the electron transmitting unit is configured such that in one direction it is arranged in arc and in the other direction it is arranged in arc or segmented arcs, or in the combination of straight lines and arcs.

In addition, in the curved surface array distributed x-ray apparatus of this disclosure, the grid-controlled apparatus includes a controller, a negative high voltage module, a positive high voltage module and a plurality of high voltage switch elements, wherein each of the plurality of high voltage switch elements at least includes a control end, two input ends, an output end, and the withstand voltage between each end at least larger than the maximum voltage formed by the negative high voltage module and the positive high voltage module, the negative high voltage module provides a stable negative high voltage to one input end of each of the plurality of high voltage switch elements and the positive high voltage module provides a stable positive high voltage to the other input end of each of the plurality of high voltage switch elements, the controller independently control each of the plurality of high voltage switch elements, the grid-controlled apparatus further has a plurality of control signal output channels, one output end of the high voltage switch elements is connected to one of the control signal output channels.

The present application provides a CT device, characterized in that, it has the curved surface array distributed x-ray apparatus as mentioned above.

The disclosure mainly provides a curved surface array distributed x-ray apparatus. A curved surface array distributed x-ray apparatus includes a plurality of electron transmitting units arranged on the curved surface, an anode, a vacuum box, a high voltage power supply connecting means, a filament power supply connecting means, a connecting means of grid-controlled apparatus, a cooling connection means, a vacuum means, a cooling means and a power supply and control system. The electron transmitting units are arranged in at least two rows in the direction of the axis on the curved surface (including the cylinder surface and annular surface), and the anode is arranged on the axis of the curved surface with a pipe through which the coolant could flow circularly in the interior. The high voltage power supply connecting means, the electron transmitting unit, the vacuum means, and the cooling connection means are installed on the wall of the vacuum box forming an overall seal structure together with the vacuum box. The cathode generates electrons under the heating effect of the filament. Typically, the grid has a negative voltage of several hundreds volts relative to the cathode confining the electrons in the electron transmitting unit. The control system controls the logic following certain settings making the grid of each electron transmitting unit obtain a positive high voltage pulse of thousands of volts. A positive electric field is formed between the grid and the cathode of the electron transmitting unit. The electrons fly to the grid through the grid mesh entering into the area of high voltage accelerating electric field between the electron transmitting unit and the anode and are accelerated by the electric field of dozens of volts to hundreds of volts, thus obtaining energy and finally bombarding the anode, hence the x-rays are generated. Because the plurality of independent electron transmitting units are arranged in multiple rows in the direction of axis on the curved surface, the position generating electron beam current is distributed. Hence, the x-rays generated by the electron beam current bombarding the anode are distributed in the direction of axis.

The disclosure mainly provides a curved surface (including the cylinder surface and annular surface) array distributed x-ray apparatus generating x-rays changing the focus position periodically in a predetermined sequence in a light source device. By employing the thermionic cathode, the electron transmitting unit of this disclosure has the advantages of large transmitting current and long service life. It is easy and flexible to control the operating state of each electron transmitting unit by grid control or cathode control. The overheat of the anode is remitted by employing the design of cooling of the tubular anode. By the curved surface array configuration of the electron transmitting unit, the density of the target spots is increased. The curved configuration of the electron transmitting units may be the cylinder surface or the annulus surface, rendering the overall to be a linear distributed x-ray apparatus or an annular distributed x-ray apparatus, so as to have flexible applications.

Applying the curved surface array distributed x-ray light source to the CT device, multiple visual angles can be generated without moving the light source, and therefore the movement of slip ring could be omitted. This contributes to simplify the structure, enhance the stability and reliability of the system, hence increasing the efficiency of inspection.

DETAILED DESCRIPTION OF THE PREFERRED EMBODIMENTS

Hereinafter, detailed description of the present disclosure will be given in combination with the accompanying drawings.

Figure 1:
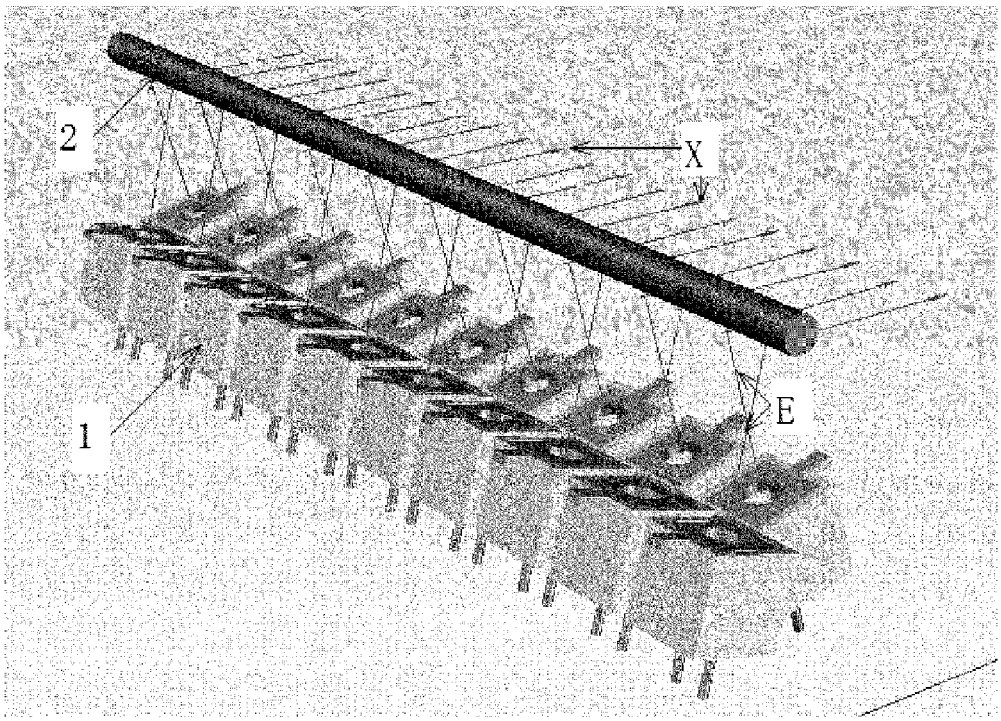
FIG. 1 is a schematic view of the structure inside the curved surface array distributed x-ray apparatus of the present application.

FIG. 1 is a schematic view of the structure inside the curved surface array distributed x-ray apparatus of the present application.

As shown in FIG. 1-8, the curved surface array distributed x-ray apparatus of the present application includes a plurality of electron transmitting units 1 (at least four, hereinafter also specifically referred to as electron transmitting unit 11*a*, 11*b*, 12*a*, 12*b*, 13*a*, 13*b*, 14*a*, 14*b* . . . ), an anode 2, a vacuum box 3, a high voltage power supply connecting means 4, a filament power supply connecting means 5, a connecting means of the grid-controlled apparatus 6, a vacuum means 8, a cooling connection means 9, a cooling means 10 and a power supply and control system 7, wherein the electron transmitting units 1 may arranged in multiple rows in the direction of the axis facing the axis O in the curved surface. In addition, the anode 2 is arranged on the axis O in the curved surface. The electron transmitting units 1, the high voltage power supply connecting means 4, and the vacuum means 8 and cooling connection means 9 are installed on the wall of the vacuum box 3 and constitutes an overall seal structure together with the vacuum box 3. The anode 2 is installed inside the vacuum box.

Figure 2:
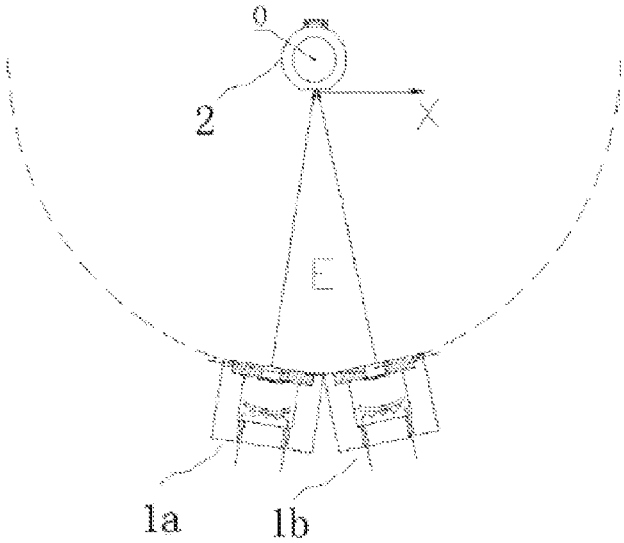
FIG. 2 is a schematic view of the end surface of the structure inside the curved surface array distributed x-ray apparatus of the present application.

In addition, the above-mentioned curved surface includes a cylinder surface and an annulus surface. FIG. 2 is a schematic view of the end surface of the structure inside the curved surface array distributed x-ray apparatus of the present application. In particular, FIG. 2 shows a schematic view of the structure inside the cylinder surface array distributed x-ray apparatus of the present application. The electron transmitting units 1 are arranged in multiple rows in the direction of the axis in the cylinder surface and the upper surface (the surface transmitting electrons) of the electron transmitting unit 1 faces the axis O. The anode 2 is arranged on the axis O of the cylinder. Usually, the electron transmitting units 1 are in the same low electric potential, and the anode 2 is in a high electric potential. A positive electric field is formed between the anode 2 and the electron transmitting unit 1. The electric field converges from the surface of each electron transmitting unit 1 to the axis of the anode 2. The electric beam current E moves toward the anode 2 from the electron transmitting unit 1 bombarding the anode 2, and finally generates x-rays.

In addition, the above-mentioned electron transmitting unit 1 can arranged in multiple rows in the direction of the axis facing the axis in the curved surface. The front rows and the rear rows of the multiple rows of the electron transmitting units may be aligned, but preferably they are offset such that the positions where the electron beams generated by each electron transmitting unit bombard the anode are not coincided.

Figure 3:
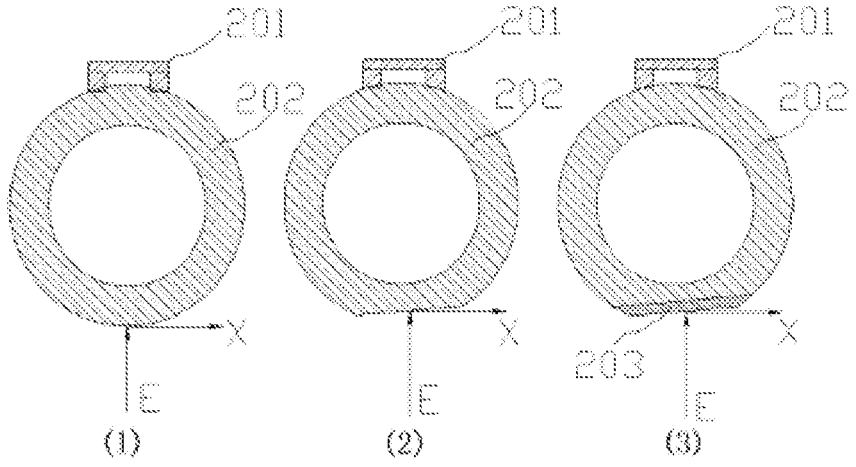
FIG. 3 is a schematic view of the anodes in different structure of the present application.

In addition, the anode 2 has a hollow pipe structure in which the coolant is movable. FIG. 3 shows a structure of the anode and the support thereof according to the present application. The anode 2 is composed of an anode support 201, an anode pipe 202, and an anode target surface 203. The anode support 201 is installed on the anode pipe 202 and connected to the top end (small end) of the high voltage power supply connecting means 4 for supporting and fixing the anode 2. The anode pipe 202 is a main structure of the anode 2. Both ends of the anode pipe are connected to one end the cooling connection means 9 and the interior of the anode pipe is communicated with the cooling connection means 9 forming a passageway in which the coolant flows circularly. The anode pipe 202 is typically made of the heat resisting metal materials and has various structures, preferably circular. In addition, in some cases, for example in the case that the thermal power of the anode is relatively small, the anode 2 may also be not a hollow cylinder pipe structure. In addition, the anode target surface is the position where the electron beams bombard the anode pipe 202 which has various design in subtle structure. For example, as shown in FIG. 3(1), the outer round face of the anode pipe 202 is the position where the electron beams bombard. In this case, the anode pipe 202 is integrally made of the heat resisting heavy metal, such as tungsten or tungsten alloy. As shown in FIG. 3 (2), a small sloping plane is formed by cutting a portion of the excircle of the anode pipe 202. The sloping plane becomes the bombarding position of the electron beam, and the sloping direction of the sloping plane is the transmitting direction of the useful x-rays. Such design of the structure contributes to transmit the useful x-ray in the same direction. Preferably, as shown in FIG. 3 (3), an anode target surface 203 is specifically provided to the outer surface of the anode pipe 202. The anode target surface 203 is made of heat resisting heavy metal, such as tungsten or tungsten alloy with a thickness no less than 20 μm (micrometer) fixed to the small sloping plane machined by the outer edge of the anode pipe 202 via electroplating, pasting, welding or other ways. In such cases, the anode pipe 202 may be made of common metal materials such that the cost can be decreased.

Figure 4:
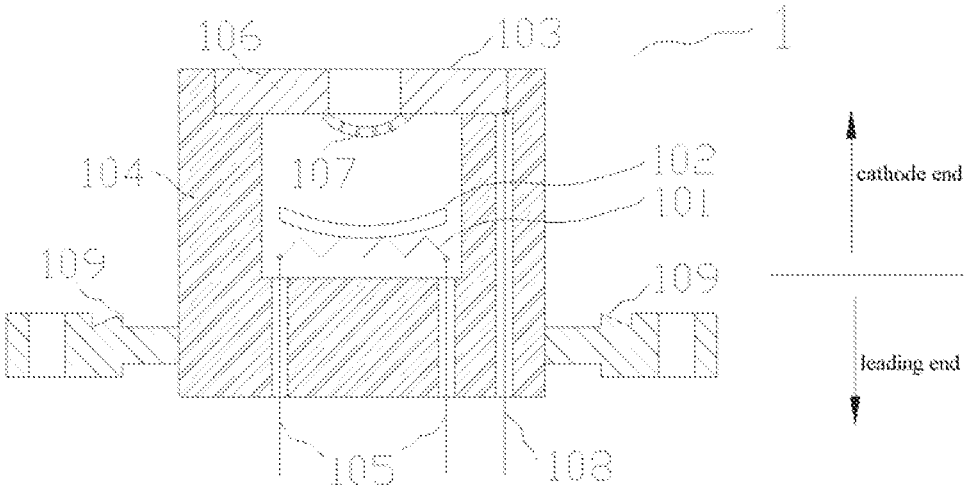
FIG. 4 is a schematic view of the structure of an electron transmitting unit of the present application.

FIG. 4 shows a specific structure of the electron transmitting unit 1, in particular, a mode that the cathode 102 and the grid 103 are integral and is controlled by the grid 103. Herein, the electron transmitting unit 1 includes a filament 101, a cathode 102, a grid 103, an insulated support 104, a filament lead 105, a connecting fastener 109. In addition, the grid 103 is composed of a grid frame 106, a grid mesh 107, a grid lead 108. In FIG. 4, the positions where the filament 101, the cathode 102, the grid 103 or the like are located is defined as the cathode end of the electron transmitting unit, and the position where the connecting fastener 109 is located is defined as the lead end of the electron transmitting unit. The cathode 102 is connected to the filament 101 which is usually made of tungsten filament. Cathode 102 is made of materials of strong capability to thermal transmit electron, such as baryta, scandate, lanthanum hexaborides etc. The insulated support 104 surrounding the filament 101 and the cathode 102 is equivalent to the housing of electron transmitting unit 1 and is made of insulated material, typically ceramic. The filament lead 105 and the grid lead 108 extend outside the lead end of the electron transmitting unit 1 through the insulated support 104. Between the filament lead 105, the grid lead 108 and the insulated support 104 is a vacuum seal structure. Grid 103 is located at the upper end of the insulated support 104 (namely, it is located at the opening of the insulated support 104) opposing the cathode 102. The grid 103 is aligned with the center of the cathode 102 vertically. The grid 103 includes a grid frame 106, a grid mesh 107, a grid lead 108, all of which are made of metal. Normally, the grid frame 106 is made of stainless steel material or Kovar material, grid mesh 107 molybdenum material, and grid lead 108 stainless steel material or Kovar material.

What's more, in particular, with respect to the structure of the grid 103, the main body thereof is a piece of metal plate (e.g. stainless steel material), that is the grid frame 106. An opening is provided at the center of the grid frame 106, the shape thereof can be square or circular etc. A wire mesh (e.g. molybdenum material) is fixed at the position of opening, namely the grid mesh 107. Moreover, a lead (e.g. stainless steel material), namely the grid lead 108, extends from somewhere of the metal plate such that the grid 103 can be connected to an electric potential. Additionally, the grid 103 is positioned right above the cathode 102. The center of the above-mentioned opening of the grid is aligned with the center of the cathode 102 (namely in a vertical line longitudinally). The shape of the opening is corresponding to that of the cathode 102. However, the opening is smaller than the area of cathode 102. However, the structure of the grid 103 is not limited to those described above as long as the electron beam current is able to pass the grid 103. In addition, the grid 103 is fixed with respect to cathode 102 by the insulated support 104.

What's more, in particular, with respect to the structure of the connecting fastener 109, preferably, the main body thereof is a circular knife edge flange with opening provided in the center. The shape of the opening may be square or circular etc. Seal connection can be provided at the opening and the outer edge of the lower end of the insulated support 104, for example, welding connection. Screw holes are formed at the outer edge of the knife edge flange. The electron transmitting unit 1 can be fixed to the walls of the vacuum box 3 by bolted connection. A vacuum seal connection is formed between the knife edge and the wall of the vacuum box 3 (In this case, the cathode end of the electronic transmitting unit 1 is located inside the vacuum box 3 and the lead end of the electron transmitting unit 1 is located outside the vacuum box 3). This is a flexible structure easy for disassemble where certain one of multiple electron transmitting units 1 breaks down it can be replaced easily. It should be noted that the connecting fastener 109 functions to achieve the seal connection between the insulated support 104 and the vacuum box 3 and various ways may be employed, for example, transition welding by metal flange, or glass high temperature melting seal connection, or welding to the metal after ceramic metallizing etc.

Figure 5:
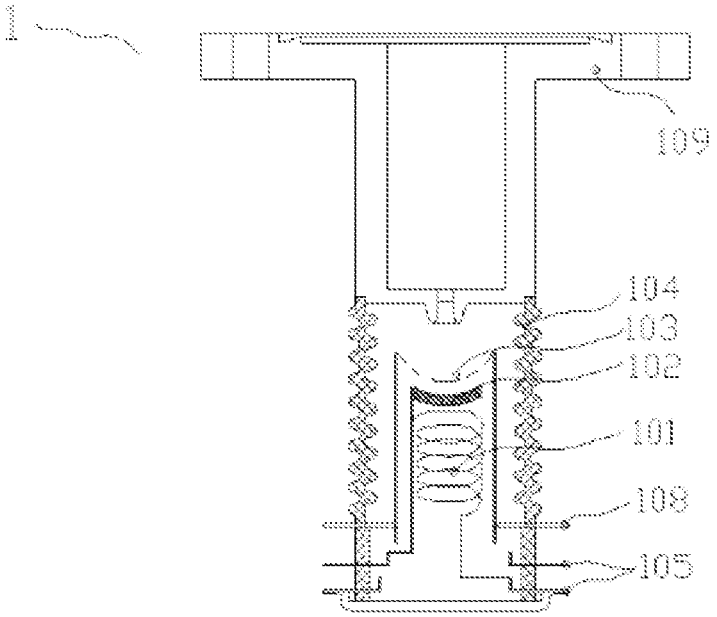
FIG. 5 is a schematic view of the structure of another electron transmitting unit of the present application.

A specific structure of another electron transmitting unit 1 is shown in FIG. 5. The electron transmitting unit 1 includes a filament 101, a cathode 102, a grid 103, an insulated support 104, a filament lead 105, a grid lead 108 as well as a connecting fastener 109. The cathode 102 is connected to the filament 101. The grid 103 is located right above the cathode 102 with a configuration identical with that of the cathode 102 and adjacent to the upper surface of the cathode 102. The insulated support 104 encloses the filament 101 and the cathode 102. The filament lead 105 extending outside both ends of the filament 101 and the grid lead 108 extending from the grid 103 are extended to the outside of the electron transmitting unit 1 though the insulated supporting 104. Between the filament lead 105, the grid lead 108 and the insulated support 104 is a seal structure. In this case, the connecting fastener 109 is connected to the upper end of the insulated support 104 and the electron transmitting unit 1 is integrally located outside the vacuum box 3.

In addition, the electron transmitting unit 1 can be an integral structure or a structure with the cathode 102 and the grid 103 separated. The operating state of the electron transmitting unit 1 can be controlled by the cathode 102 or by the grid 103.

Figure 6:
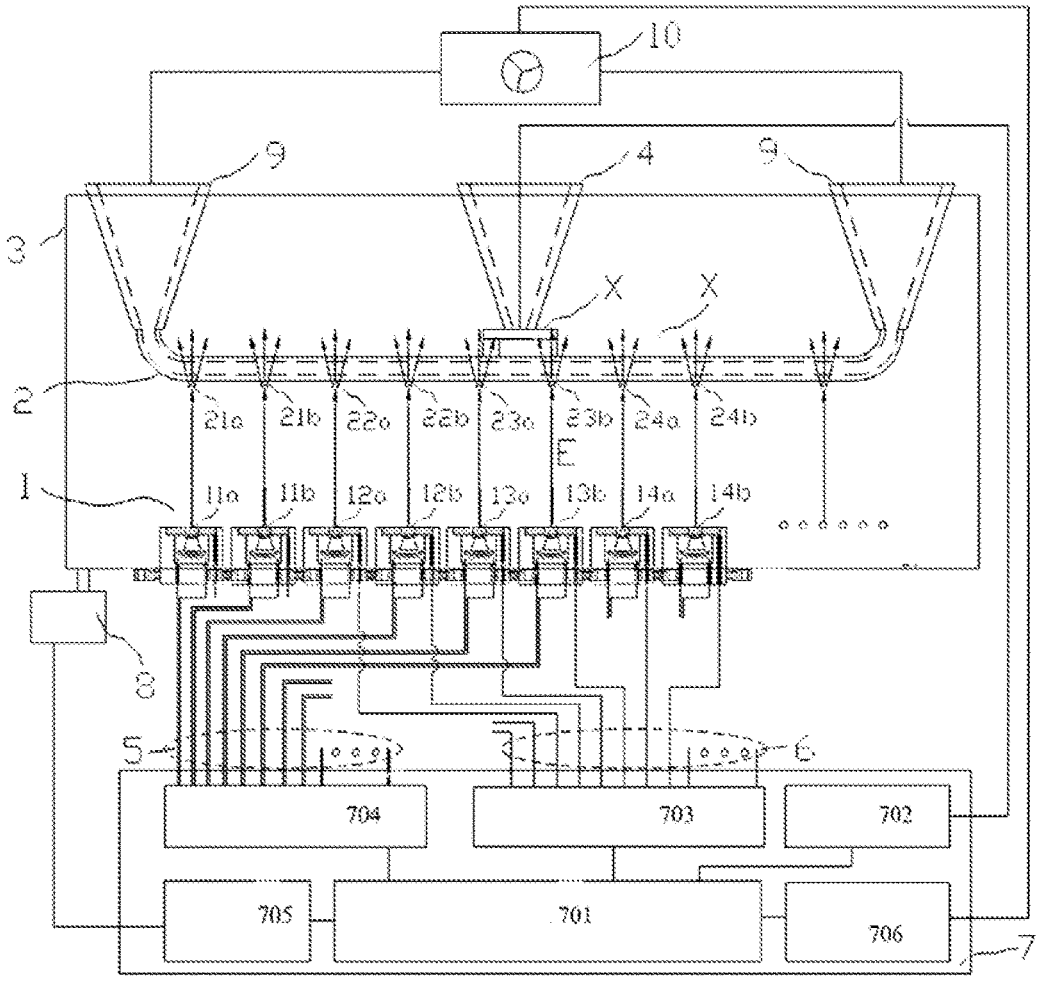
FIG. 6 is a schematic view of the overall configuration of a curved surface array distributed x-ray apparatus of the present application.

FIG. 6 shows an overall structure of a curved surface array distributed x-ray apparatus, wherein the vacuum box 3 is a housing of a cavity with its periphery sealed and the interior thereof is high vacuum. The electron transmitting units 1 for generating the electron beam current as required are installed on the wall of the vacuum box 3. The anode 2 for forming high voltage accelerating electric field and generating x-rays is installed inside the vacuum box 3. The high voltage power supply connecting means 4 for connecting the anode 2 to the cable of the high voltage power supply 702 is installed on the side wall at the end adjacent to the anode 2. The cooling connection means 9 is used to connect both ends of the anode 2 and a cooling means 10 constituting a circulation loop for the coolant is connected outside the vacuum box 3 and installed to the side wall of the vacuum box 3 adjacent to the anode 2. The filament power supply connecting means 5 for connecting the filament 101 to the filament power supply 704 are normally a plurality of multi-core cables with connectors at both ends. The connecting means of grid-controlled apparatus 6 for connecting the grid 103 of the electron transmitting unit 1 to the grid-controlled apparatus 703 are typically a plurality of coaxial cable with connectors at both ends. A vacuum means 8 for maintaining the high vacuum in the vacuum box 3 is installed on the side wall of the vacuum box 3.

In addition, the high voltage power supply connecting means 4 is a tapered structure with the large end seal connected to the vacuum box 3 and the small end connected to the anode 2. Typically, it is made of vacuum insulated materials such as ceramics etc. After both ends of the high voltage power supply connecting means 4 is metallized, the large end is welded to the wall of the vacuum box 3 forming a seal structure. After the small end is metallized, it is welded to the flange to which the anode 2 is fixed by the anode support 201. The interior of the high voltage power supply connecting means 4 is a hollow conical pipe with its small end closed and a high voltage lead communicated with the flange is provided in the center. The high voltage power supply connecting means 4 of a specific shape may enter into the conical pipe from the large end of the high voltage power supply connecting means 4 and connected to the high voltage lead.

In addition, the cooling means 10 is a constant temperature cooling system including at least a circulation pump and a refrigerating system and is operating under the control of the cooling control means 706. The circulation pump is used to circulate the coolant in the seal loop composed of the anode pipe 202, the cooling connection means 9 and the cooling means 10. The refrigerating system is used to control the circulation of the coolant and discharge the heat and thereby decreasing the temperature of the coolant. The cooling control means 76 is used to control the operating of the cooling means 10 comprising keeping a constant temperature for the coolant flowed out from the cooling means 10; maintaining sufficient pressure and flow; detecting the temperature of the coolant; sending the feedback of trouble signal to the control means 701 of a higher level in real time where abnormal flow or abnormal temperature occurs or the cooling means breaks down due to other reasons.

In addition, the cooling connection means 9 is usually made of vacuum insulated materials, such as ceramic or glass. The number of the cooling connection mean 9 is typically two. Each cooling connection mean 9 is seal connected to the vacuum box 3 at one end and coupled to the cooling means 10 by pipe outside the vacuum box 3 and connected to both ends of the anode 2 respectively at the other end within the vacuum box 3. The cooling connection means 9 may be a tapered structure, or a common pipe structure, or a spiral pipe structure, and a glass spiral pipe is preferable.

Figure 7:
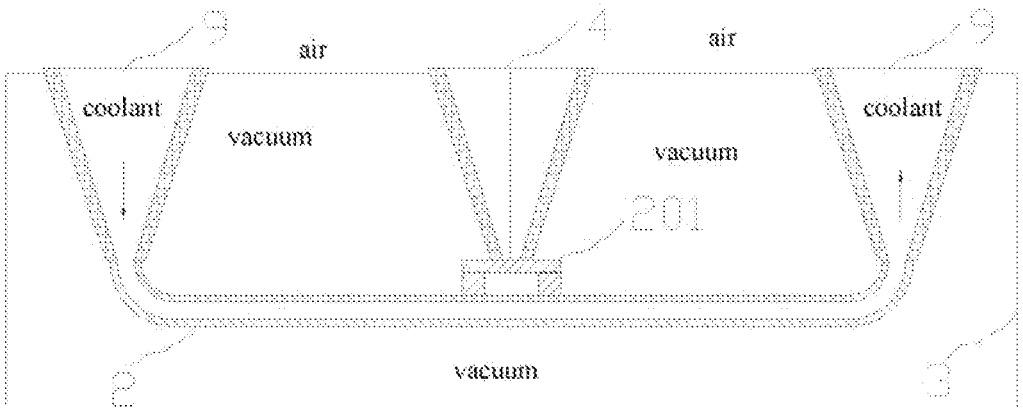
FIG. 7 is a schematic view of the connection structure of the anode and different cooling structure in the present application.
Figure 7:
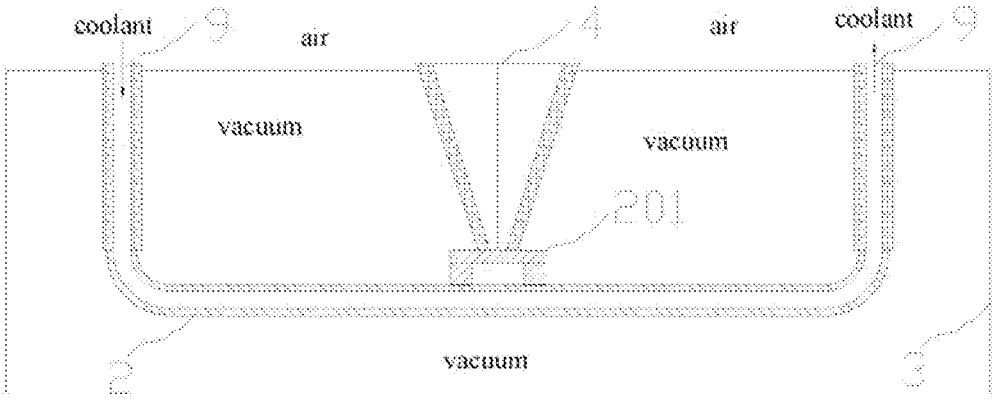
Figure 7:
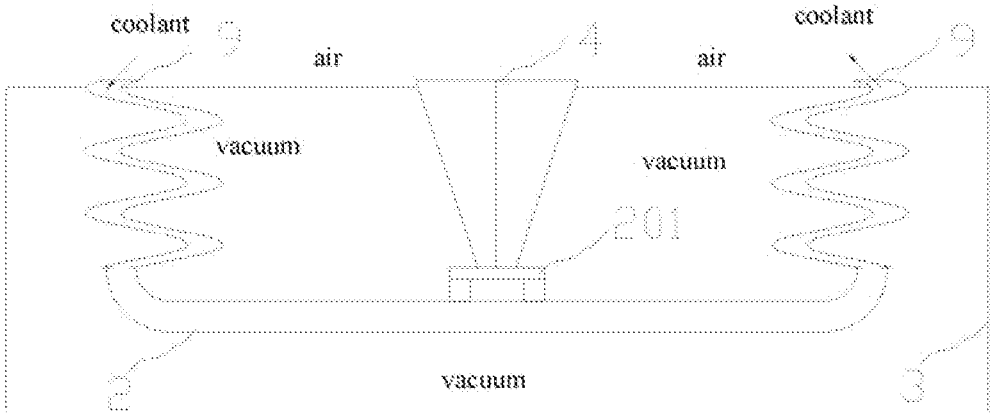

In addition, FIG. 7 shows a schematic view of the different structure of the cooling connecting means 9 in the present application. As shown in FIG. 7(1), the cooling connection means 9 adopts the same tapered structure as that of the high voltage power supply connecting means 4. It may be made of ceramics with both ends metallized. The metallized edge of the large end is welded to the vacuum box 3 forming a vacuum seal connection. The metallized edge of the small end is welded to the ends of the anode 2 and the interior forms a channel in which the coolant can flow. As shown in FIG. 7 (2), the cooling connection means 9 is a common pipe and may be made of ceramics or glass material. The cooling connection means 9 may be connected tightly to the vacuum box 3 at one end forming a seal structure and connected to the anode 2 at the other end, thus the interior forms a channel in which the coolant could move. As shown in FIG. 7 (3), preferably, the cooling connection means 9 is a spiral structure wounded by the common pipe, such as glass spiral pipe and is connected to the vacuum box 3 tightly at one end forming a vacuum seal structure and connected to the anode 2 at the other end, thus forming a channel in which the coolant could move. The spiral pipe increases the length of the pipe in a limited space, therefore improving the capability of insulation and voltage withstanding.

In addition, the coolant is the flowable high voltage insulated material, for example, transformer oil (high voltage transformer oil) or sulfur hexafluoride gas (SF6), preferably the transformer oil.

In addition, the power supply and control system 7 includes a control system 701, a high voltage power supply 702, a grid-controlled apparatus 703, a filament power supply 704, a vacuum power supply 705, a cooling control means 706 etc. The High voltage power supply 702 is connected to the anode 2 by the high voltage power supply connecting means 4 installed on the wall of the vacuum box 3. The grid-controlled apparatus 703 is connected to each grid lead 108 respectively by the connecting means of grid-controlled apparatus 6. The number of the output lines of the grid-controlled apparatus 703 is same as that of the number of grid leads 108. The filament power supply 704 is connected to each filament lead 105 by the filament power supply connecting means 5 and usually has independent filament leads 105, the number of which is same as that of the electron transmitting units 1 (namely, as mentioned above, each electron transmitting unit has a set of filament leads, 2 filament leads, for connected to both ends of the filament). The number of the output loop of the filament power supply 704 is same as that of the filament leads 105. The vacuum power supply 705 is connected to the vacuum means 8 and the cooling control means 706 is connected to the cooling means 10. The operating condition of the high voltage power supply 702, the grid-controlled apparatus 703, the filament power supply 704, and the vacuum power supply 705, the cooling control mean 706 etc may be controlled and managed synthetically by the control system 701.

Figure 8:
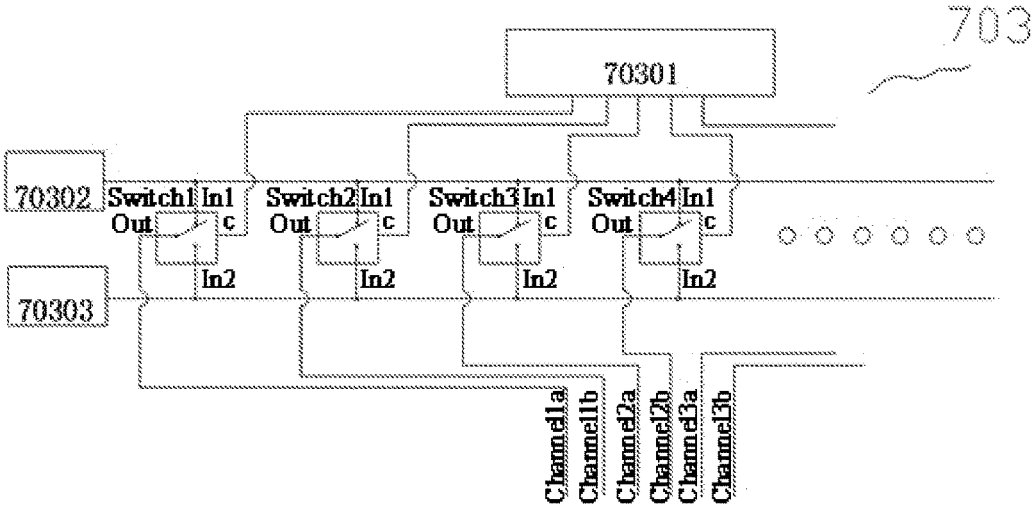
FIG. 8 is a schematic view of the structure of a grid-controlled apparatus in the present application.

In addition, as shown in FIG. 8, the grid-controlled apparatus 703 includes a controller 70301, a negative high voltage module 70302, a positive high voltage module 70303 and a plurality of high voltage switch elements switch 1, switch 2, switch 3, and switch 4 . . . . Each of the plurality of high voltage switch elements at least includes a control end (C), two input ends (In1 and In2), an output end (Out). The withstand voltage between each end must be larger than the maximum voltage formed by the negative high voltage module 70302 and the positive high voltage module 70303 (that is to say, if the output of negative high voltage is −500V and the output of the positive high voltage is +2000V, the withstand voltage between each end must be larger than 2500V at least). The controller 70301 has independently multipath output, and each path is connected to the control end of a high voltage switch element. The negative high voltage module 70302 provides a stable negative high voltage, typically negative hundreds of volts. The range of negative high voltage can be 0V to −10 kV, and −500V is preferred. The negative high voltage is connected to one input end of each high voltage switch element. In addition, the positive high voltage module 70303 provides a stable positive high voltage, typically positive thousands of volts. The range of positive high voltage can be 0V to +10 k and +2000V is preferred. The positive high voltage is connected to the other input end of each high voltage switch element. The output end of each high voltage switch element is connected to control signal output channel channel 11*a*, channel 11*b*, channel 12*a*, channel 12*b*, channel 13*a*, channel 13*b* . . . , thus forming multipath to output control signal. Controller 70301 controls the operating state of each high voltage switch element such that the control signal of each output channel is negative high voltage or positive high voltage.

In addition, the power supply and control system 7 can adjust the current magnitude of each output loop of filament power supply 704 under different using condition so as to adjust the heating temperature that each heating filament 101 applies to the cathode 102 for changing the magnitude of transmitting current of each electron transmitting unit 1 and finally adjusting the intensity of x-ray transmitted each time. In addition, the intensity of the positive high voltage control signal for each output channel of the grid-controlled apparatus 703 can be adjusted so as to changing the magnitude of transmitting current of each electron transmitting unit 1 and finally adjusting the intensity of x-ray transmitted each time. Additional, the operating timing sequence and combining operating mode of each electron transmitting unit 1 can be programmed to realize flexible control.

Figure 9:
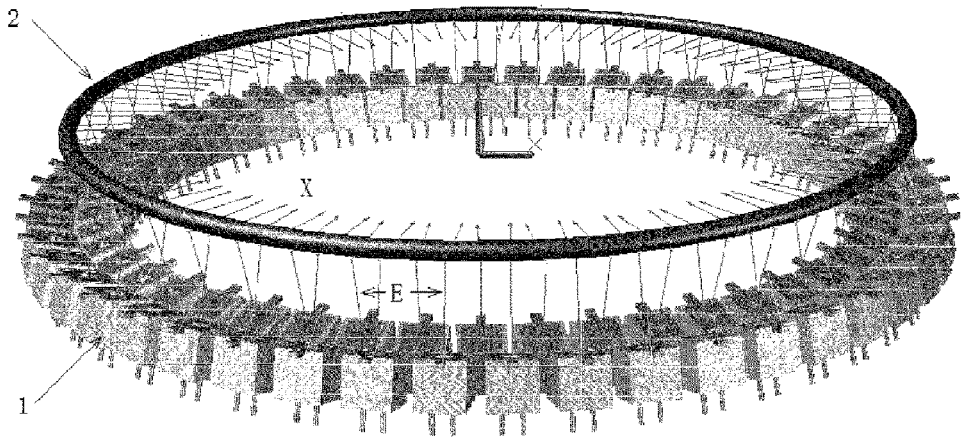
FIG. 9 is a schematic view of the configuration of electron transmitting unit and the anode inside the annular-shaped distributed x-ray apparatus of the present application.

In addition, it should be noted that, in the cured surface array distributed x-rays of the present application, the axis thereof may be a straight line or an arc, rendering the overall to be a linear distributed x-ray apparatus or an annular distributed x-ray apparatus, so as to meet different application requirements. FIG. 9 shows a view of the arrangement effect of the electron transmitting unit and the anode of the annular distributed x-ray apparatus of the present application. The anodes 2 are arranged in a flat circumference and the electron transmitting units 1 are disposed below the anode 2. Two rows of electron transmitting units 1 are arranged in a circle in the direction of anode 2 and arranged in the cambered surface which adopts the center of the anode 2 as the axis, that is to say, the surface of the grid 103 of each electron transmitting unit 1 is directed to the axis of the anode 2. The electron beam current E is transmitted from the surface of the grid 103 of the electron transmitting unit 1 and accelerated by the high voltage electric field between the anode 2 and the electron transmitting unit 1, and finally bombards the target surface at the lower edge of the anode 2 forming an array of x-ray target spots in circular arrangement on the anode 2. The transmitting direction of useful x-ray is directed to the center of the circle of the anode 2. The vacuum box 3 of the annular distributed x-rays is also in an annular shape corresponding to the configuration of the electron transmitting unit 1 and the shape of the anode 2. The annular distributed x-rays apparatus may be a complete annulus or a section of the annulus and may be applied to the occasions where the x-rays needs being arranged in a circle.

In addition, it should be noted that in the curved surface array distributed x-ray apparatus of the disclosure, the array of the electron transmitting units may be arranged in two rows or multiple rows.

In addition, it should be noted that in the description of the electron transmitting unit in the present application, 'independently' refers to that each electron transmitting unit is capable of transmitting the electron beam independently. With regards to the specific structure, it may be a separated structure or may be a certain kind of coupled structure.

In addition, it should be noted that in the description of the curved surface array distributed x-ray apparatus of the disclosure, 'curved surface' refers to various forms of curved surfaces, including the cylinder surface, the annular surface, the ellipse surface, or the curved surface composed by segmented straight lines, for example, the surface of the regular polygon column, or the curved surface composed by segmented arcs, preferably the cylinder surface and the annular surface as mentioned above.

In addition, it should be noted that in the description of the curved surface array distributed x-ray apparatus of the disclosure, 'axis' refers to a real axis or an axis in form of the curved surface in which the electron transmitting units are disposed. For example, the axis of the cylinder surface refers to the central axis of the cylinder, and the axis of the annulus surface refers to the central axis inside the annulus. The axis of the elliptic surface refers to the axis adjacent to the paraxial of the ellipse, and the axis of the surface of the regular polygon column refers to the axis composed by the center of the regular polygon.

In addition, it should be noted that in the description of the curved surface array distributed x-ray apparatus of the disclosure, the cross-section of the pipe inside the anode may be a circular hole, a square hole, a polygon hole, a hole in the shape of an internal gear with heat dispersion fin, or other shape that can increase the radiating area.

In addition, it should be noted that in the description of the curved surface array distributed x-ray apparatus of the disclosure, the curved array of the electron transmitting unit is configured such that in one direction it is arranged in arc and in the other direction it is arranged in a straight line or segmented lines, in arc or segmented arcs, or in the combination of line segments and arc segments.

In addition, it should be noted that in the description of the curved surface array distributed x-ray apparatus of the disclosure, the configuration of the curved array configuration may space uniformly in both directions, or may space uniformly in each direction but the spaces of two directions are different, or may space uniformly in one direction but non-uniformly in the other direction, or may space uniformly in neither direction.

In addition, it should be noted that in the description of the curved surface array distributed x-ray apparatus of the disclosure, the configuration of the vacuum box may integrally be a cuboid body, a cylinder body, an annulus body, or other structure that does not hinder the opposing configuration of the electron transmitting unit and the anode.

Embodiments (System Configuration)

As shown in FIG. 1-8, the curved surface array distributed x-ray apparatus of this disclosure, in particular the cylinder surface array distributed x-ray apparatus includes a plurality of electron transmitting units 1, an anode 2, a vacuum box 3, a high voltage power supply connecting means 4, a filament power supply connecting means 5, a connecting means of grid-controlled apparatus 6, a vacuum means 8, a cooling connection means 9, a cooling means 10 and a power supply and control system 7. The plurality of electron transmitting units 1 are arranged in two rows in the direction of the axis opposing the axis and are installed on the wall of the vacuum box 3. The anode 2 is arranged in the axis of the cylinder and surrounded by the vacuum box 3. The anode 2 has a hollow pipe structure in which the coolant is flowable. The anode 2 is composed of an anode support 201, an anode pipe 202, and an anode target surface 203. The anode pipe 202 is a main structure of the anode 2 with some length, e.g. 30-100 cm. The anode support 201 is located in the middle piece in the rear surface of the anode pipe 202 and connected to the top end (small end) of the high voltage power supply connecting means 4 for supporting and fixing the anode 2. Both ends of the anode pipe 202 are connected to one end the cooling connection means 9 and the interior of the anode pipe is communicated with the cooling connection means 9 forming a passageway for the coolant. The coolant is the transformer oil having the characteristics of high voltage insulation. A small sloping plane is formed by cutting a portion of the excircle of the anode pipe 202 and the anode target surface 203 being bombarded by the electron beam and generating x-rays is installed on the sloping plane and thus the transmitted directions of the useful x-rays keep consistent. The anode target surface 203 is made of tungsten material with a thickness of 200 μm fixed by electroplating. In addition, the electron beam bombards the anode and the x-rays generated are transmitted in 360 degrees but when in use, only a portion in a certain direction can be used and this portion is called useful x-rays. The electron transmitting unit 1 is composed of a filament 101, a cathode 102, a grid 103, an insulated support 104, a filament lead 105 and a connecting fastener 109. In addition, the grid 103 is composed of a grid frame 106, a grid mesh 107 and a grid lead 108. The electron transmitting units 1 are arranged in two long rows in the length direction of the anode 2 below the anode target surface 203. For example, the electron transmitting units in the first rows are 11*a*, 12*a*, 13*a* . . . and in the second row are 11*b*, 12*b*, 13*b* . . . . The upper surface of each electron transmitting unit 1 (the surface of the grid 103) faces the anode 2, that is, the two rows of the electron transmitting units 1 are not in a plane, but in a cylinder surface with the anode 2 taken as the axis. The high voltage power supply connecting means 4 is installed to the vacuum box 3 at the end adjacent to the anode, is connected to the anode 2 inside the vacuum box 3 and the exterior thereof is connected to the high voltage power supply 702. The filament lead 105 of each electron transmitting unit 1 is connected to the filament power supply 704 by the filament power supply connecting means 5. The filament power supply connecting means 5 is the two-core cable with connectors at both ends. The grid lead 108 of each electron transmitting unit 1 is connected to the grid-controlled apparatus 703 by the connecting means of grid-controlled apparatus 6. The connecting means of grid-controlled apparatus 6 are multiple high voltage coaxial cables with connectors at both ends. The vacuum means 8 is installed on the side wall of the vacuum box 3. Two cooling connection means 9 are installed to the vacuum box 3 at the end adjacent to the anode 2 and is connected to both ends of the anode 2 inside the vacuum box 3 and is connected to the cooling means 10 outside the vacuum box 3. The electron transmitting unit 1, the high voltage power supply connecting means 4, the vacuum means 8, the cooling connection means 9 and the vacuum box 3 form an integral seal structure. The power supply and control system 7 includes multiple modules including a control system 701, a high voltage power supply 702, a grid-controlled apparatus 703, a filament power supply 704, a vacuum power supply 705, a cooling control means 706 etc., those of which are connected to the components of the system including the filaments 101 of multiple electron transmitting units 1, grid 103 and anode 2, vacuum means 8, cooling means 10 etc by power cable and controlling cable.

(Operating Principle)

In the cylinder surface array distributed x-ray apparatus of this disclosure, the power supply and control system 7 controls the filament power supply 704, the grid-controlled apparatus 703 and the high voltage power supply 702. Under the effect of the filament power supply 704, the cathode 102 is heat to 1000-2000° C. by the filament 101 and a large number of electrons are generated at the surface of the cathode 102. Each grid 103 is in the negative voltage, e.g. −500V, due to the grid-controlled apparatus 703. A negative electric field is formed between the grid 103 and the cathode 102 of each electron transmitting unit 1 and the electrons are limited to the surface of the cathode 102. Anode 2 is in a much high positive voltage, e.g. +180 KV, due to the high voltage 702, and a positive accelerating electric field is formed between the electron transmitting unit 1 and the anode 2. In the case that needs generation of x-ray, the output of a certain path of the grid-controlled apparatus 703 is converted from negative voltage to positive voltage by the control system 701 following instruction or preset program. The output signal of each path is converted in accordance with the time sequence, for example, the voltage of the output channel 1*a* of the grid-controlled apparatus 703 is changed from −500V to +2000V at the moment 1. In the corresponding electron transmitting unit 11*a*, the electric field between the grid 103 and the cathode 102 is changed to positive. The electrons move to the grid 103 from the surface of the cathode 102 and enter into the positive electric field between the electron transmitting unit 11*a* and anode 2 through the grid mesh 107. Thus, the electrons are accelerated and changed to high energy, and finally bombard the target surface 203 transmitting the x-rays at the position of 21*a*. The voltage of the output channel 1*b* of the grid-controlled apparatus 703 is changed from −500V to +2000V at the moment 2. The corresponding electron transmitting unit 11*b* transmits electrons, thus bombarding target surface 203 and the x-rays are transmitted at the position of 21*b*. The voltage of the output channel 2*a* of the grid-controlled apparatus 703 is changed from −500V to +2000V at the moment 3. The corresponding electron transmitting unit 12*a* transmits electrons, thus bombarding the target surface 203 and the x-rays are transmitted at the position of 22*a*. The voltage of the output channel 2*b* of the grid-controlled apparatus 703 is changed from −500V to +2000V at the moment 4. The corresponding electron transmitting unit 12*b* transmits electrons, thus bombarding target surface 203 and the x-rays are transmitted at the position of 22*b*. The rest can be done in the same manner. Then x-rays are generated at the position of 23*a*, and then x-rays are generated at the position of 23*b* . . . and that cycle repeats. Therefore, by the grid control, the control system makes each electron transmitting unit 1 work alternately to transmit electron beam following a predetermined time sequence and generate x-rays alternately at different positions of anode target surface so as to become the distributed x-ray source.

The gas generated when the anode target surface 203 is bombarded by the electron beam current is drawn out by the vacuum means 8 in real time, and a high vacuum is maintained in the vacuum box 3, thus facilitating the stable operation for a long time. When the anode target surface 203 is bombarded by the electron beam current, a lot of heat is generated simultaneously and the temperature is increased. The heat is conducted to the anode pipe 202 and taken away by the coolant circulated inside the anode pipe 202, therefore the temperature of the anode target surface maintains not too high. In addition to control each power supply to drive each component working coordinately following the preset program, the control system can receive the feedback signal given by the high-voltage power supply, the vacuum power supply and the cooling control for coordinated control, it can also receive external command by the communication interface and the human-computer interface to modify and set key parameters of the system as well as update the program the adjust automatic control.

In addition, the curved surface array distributed x-ray light source of this disclosure can be applied to CT device so as to obtain a CT device of good stability, excellent reliability and high efficiency for inspection.

(Effects)

The disclosure provides a curved surface (including the cylinder surface and annular surface) array distributed x-ray apparatus generating x-rays changing the focus position periodically in a predetermined sequence in a light source device. By employing the thermionic cathode, the electron transmitting unit of this disclosure has the advantages of large transmitting current and long service life. It is easy and flexible to control the operating state of each electron transmitting unit by grid control or cathode control. The overheat of the anode is remitted by employing the design of cooling of the tubular anode. By the curved surface array configuration of the electron transmitting unit, the density of the target spots is increased. The curved configuration of the electron transmitting units may be the cylinder surface or the annulus surface, rendering the overall to be a linear distributed x-ray apparatus or an annular distributed x-ray apparatus, so as to have flexible applications.

In addition, applying the curved surface array distributed x-ray light source to the CT device, multiple visual angles can be generated without moving the light source, and therefore the movement of slip ring could be omitted. This contributes to simplify the structure, enhance the stability and reliability of the system, hence increasing the efficiency of inspection.

Embodiments have been disclosed above for the purpose of illustration but are not limited thereto. It should be appreciated that various modifications and combination are possible without departing from the scope and spirit of the accompanying claims.

LIST OF REFERENCE NUMBERS

1: electron transmitting unit
2: anode;
E: electronic beam current;
X: x-ray;
1*a*: electron transmitting unit (the first row)
1*b*: electron transmitting unit (the second row)
201: anode support
202: anode pipe
203: anode target surface
101: filament;
102: cathode;
103: grid;
104: insulated support;
105: filament lead;
106: grid frame;
107: grid mesh;
108: grid lead;
109: connecting fastener;
3: vacuum box;
4: high voltage power supply connecting means;
5: filament power supply connecting means;
6: connecting means of grid-controlled apparatus;
7: power supply and control system;
8: vacuum means;
9: cooling connection means;
10: cooling means;
701: control system;
702: high voltage power supply;
703: grid-controlled apparatus;
704: filament power supply;
705: vacuum power supply;
706: cooling control means;
70301: controller;
70302: negative high voltage module;
70303: positive high voltage module;
Switch: high voltage switch element;
Channel: Output channel for control signal;

The invention claimed is:

1. An x-ray apparatus, comprising:

a vacuum box which is sealed at its periphery, wherein the interior thereof is in vacuum;

an anode comprising a curved surface and arranged in the vacuum box, wherein a longitudinal axis of the anode extends through a center of the anode and lies in parallel with the curved surface; and a plurality of electron transmitting units arranged on a wall of the vacuum box in multiple rows parallel to the longitudinal axis of the anode, the plurality of electron transmitting units facing the curved surface of the anode.

2. The x-ray apparatus according to claim 1, further comprising:

a power supply and control system having:

a high voltage power supply connected to the anode;

a filament power supply connected to each of the plurality of the electron transmitting units;

a grid-controlled apparatus connected to each of the plurality of electron transmitting units; and a control system for controlling each power supply, wherein the anode comprises:

an anode pipe made of metal and having a hollow pipe shape;

an anode support arranged on the anode pipe; and an anode target surface provided on an outer surface of the anode pipe and facing the electron transmitting units.

3. The x-ray apparatus according to claim 2, wherein the anode target surface is a sloping plane formed by cutting a portion of an excircle of the anode pipe.

4. The x-ray apparatus according to claim 2, wherein the anode target surface is formed by forming heavy metal material tungsten or tungsten alloy on a sloping plane formed by cutting a portion of an excircle of the anode pipe.

5. The x-ray apparatus according to claim 2, wherein each of the plurality of electron transmitting units has:

a filament;

a cathode connected to the filament;

an insulated support having an opening and enclosing the filament and the cathode;

filament leads extending from both ends of the filament;

a grid arranged above the cathode opposing the cathode; and a connecting fastener connected to the insulated support, wherein, each of the plurality of electron transmitting units is installed on the wall of the vacuum box forming a vacuum seal connection, the grid comprises:

a grid frame which is made of metal and provided with an opening in the center;

a grid mesh which is made of metal and fixed at a position of the opening of the grid frame; and a grid lead, extending from the grid frame, the filament leads connected to the filament power supply and the grid lead connected to the grid-control apparatus extend to the outside of the plurality of electron transmitting units through the insulated support, and a surface of the grid faces the axis of the anode.

6. The x-ray apparatus according to claim 5, wherein the connecting fastener is connected to an outer edge of a lower end of the insulated support, and a cathode end of each of the plurality of electron transmitting units is located inside the vacuum box while a lead end of each of the plurality of electron transmitting units is located outside the vacuum box.

7. The x-ray apparatus according to claim 5, wherein the connecting fastener is connected to an upper end of the insulated support and the plurality of electron transmitting units is located outside the vacuum box.

8. The x-ray apparatus according to claim 5, further comprising:

a high voltage power supply connecting means connecting the anode to a cable of the high voltage power supply and installed to a side wall of the vacuum box at an end adjacent to the anode;

a filament power supply connecting means for connecting the filament to the filament power supply;

a connecting means of grid-controlled apparatus for connecting the grid of the electron transmitting unit to the grid-controlled apparatus;

a vacuum power supply included in the power supply and control system; and a vacuum means installed on a side wall of the vacuum box maintaining high vacuum in the vacuum box utilizing the vacuum power supply.

9. The x-ray apparatus according to claim 2, further comprising:

a cooling means;

a cooling connection means connected to the cooling means outside the vacuum box and connected to the anode and installed on a side surface of the vacuum box adjacent to the anode; and a cooling control means included in the power supply and control system for controlling the cooling means.

10. The x-ray apparatus according to claim 1, wherein the axis of the curved surface is a straight line or segmented straight line.

11. The x-ray apparatus according to claim 1, wherein the axis is an arc.

12. A computed tomography device, comprising the x-ray apparatus according to claim 1.

* * * * *